US006859963B2

(12) United States Patent
Sawatzky

(10) Patent No.: US 6,859,963 B2
(45) **Date of Patent: *Mar. 1, 2005**

(54) CARABINER ATTACHMENT BRACKET FOR A BASKET RESCUE STRETCHER

(75) Inventor: Randal G. Sawatzky, Westbank (CA)

(73) Assignee: Traverse Rescue LLC, Kelowna (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/797,113

(22) Filed: Mar. 11, 2004

(65) Prior Publication Data

US 2004/0172759 A1 Sep. 9, 2004

Related U.S. Application Data

(63) Continuation of application No. 10/361,580, filed on Feb. 11, 2003, now Pat. No. 6,725,480.
(60) Provisional application No. 60/355,787, filed on Feb. 12, 2002.

(51) Int. Cl.[7] ..... A47B 1/00

(52) U.S. Cl. ..... 5/626; 5/625; 244/137.2

(58) Field of Search ..... 5/424, 625, 626, 5/627, 628, 629; 244/137.1, 137.2, 137.3, 137.4

(56) References Cited

U.S. PATENT DOCUMENTS

| | | | | | |
|---|---|---|---|---|---|
| 1,557,647 | A | * | 10/1925 | Austin | 5/628 |
| 2,400,426 | A | * | 5/1946 | Liptay et al. | 5/625 |
| 3,135,972 | A | * | 6/1964 | Jakes et al. | 5/627 |
| 3,222,080 | A | * | 12/1965 | Kinraide | 280/18 |
| 3,890,659 | A | * | 6/1975 | Staubs | 5/625 |
| 4,183,110 | A | * | 1/1980 | Kidd et al. | 5/629 |
| 4,564,161 | A | * | 1/1986 | Frye | 244/137.2 |
| D311,713 | S | * | 10/1990 | McAfee et al. | D12/133 |
| 5,005,266 | A | * | 4/1991 | Fister et al. | 24/601.5 |
| 5,156,233 | A | * | 10/1992 | Olsen et al. | 182/3 |
| 5,249,321 | A | * | 10/1993 | Graf | 5/494 |
| 5,398,358 | A | * | 3/1995 | Mercke et al. | 5/625 |
| 6,527,285 | B1 | * | 3/2003 | Calandro, II | 280/87.051 |

* cited by examiner

*Primary Examiner*—Teri Pham Luu
(74) *Attorney, Agent, or Firm*—Antony C. Edwards

(57) ABSTRACT

A pair of carabiner mounting members are rigidly mounted or mountable to each top rail of a basket rescue stretcher. The carabiner mounting members are mounted or mountable spaced longitudinally apart along the each top rail. Each carabiner mounting member extends into the stretcher cavity and defines a carabiner receiving opening which lies in a first plane which is perpendicular both to a vertical second plane containing the corresponding top rail to which the carabiner mounting member is mounted or mountable and to a horizontal third plane which contains the pair of top rails on opposite sides of the stretcher.

16 Claims, 5 Drawing Sheets

CARABINER ATTACHMENT BRACKET FOR A BASKET RESCUE STRETCHER

CROSS REFERENCE TO RELATED APPLICATION

This application is a Continuation of U.S. patent application Ser. No. 10/361,580 filed Feb. 11, 2003, now U.S. Pat. No. 6,725,480 which claims priority from U.S. Provisional Patent Application No. 60/355,787 filed Feb. 12, 2002, entitled Attachment Bracket for a Basket Rescue Stretcher.

FIELD OF THE INVENTION

This invention relates to an improvement in basket rescue stretchers and in particular to a carabiner attachment for stretchers such as stokes litters.

BACKGROUND OF THE INVENTION

A basket rescue stretcher of the type utilized by emergency personnel is well known. It generally comprises a sturdy, light-weight, open frame manufactured from stainless steel tubing or like material, comprising both longitudinal and lateral components which are secured by welding or the like, into an integral unit. Common to most rescue stretchers of this type is a sturdy peripheral top rail surrounding the basket stretcher opening, which lends rigidity and strength to the stretcher and also provides a convenient hand-hold for emergency personnel when transporting and injured patient.

Conventional basket rescue stretchers are manufactured from stainless steel components, which are welded together. They generally have a sturdy peripheral top rail of 1-inch diameter, which surrounds the basket stretcher opening and one or more intermediate rails of ½ inch diameter material, spaced from and generally parallel to the top rail. Lateral components, or ribs, are secured by welding to the underside of top rail and to the outside of the intermediate rails. The first intermediate rail is generally spaced 2 inches clear of the top rail.

The top rail is generally the most convenient attachment point for a tether such as ropes or webbing or the like, which enable emergency personnel to either raise or lower the basket rescue stretcher adjacent to a building or an escarpment. Such tethers are commonly secured to the top rail by screwgate carabiners, which are inserted through a preformed loop made in the tether and clipped over the peripheral top rail. The tether may be a so-called litter bridle or sling arrangement which may include four equal length ropes or webbing belts connected to a single lifting ring.

Such carabiners are sturdy connection devices, ideally suited to quick connection and release situations. They have a smoothly contoured 'D' shape that will only minimally abrade ropes or harnesses. Carabiners may often have corner radii which are smaller than the radius of the tubular top rail. For example a typical top rail may have a radius of ½ to ⅝ of an inch (1 to 1¼ inch diameter) whereas a carabiner may often have a corner radius which is significantly smaller. Thus, the difference in top rail and carabiner diameters prevents the carabiner from properly contacting the underside of the top rail of the basket stretcher as tension is applied. In situations where a "shock load" is placed on the basket stretcher, such as if a loaded stretcher was dropped a short distance and then arrested by the carabiners and connecting tethers, opposite sides of the tubular top rail could be crushed slightly, thereby weakening the rail and perhaps rendering the stretcher unsafe for use.

When the carabiner is clipped over the peripheral top rail of a basket rescue stretcher and tension applied to the connecting tethers, the carabiner will slide along the top rail unless the direction of the tension is close to a right angle with the top rail, or movement of the carabiner is arrested by contact with one of the lateral frame components secured to the top rail. Such movement of the connecting point between tether and stretcher in undesirable since it results in an imbalance of both stretcher and patient and could further endanger the patient.

Further, as tension is applied to the tether straps during suspension of the basket stretcher, the top rail of the basket stretcher prohibits the carabiner from rotating so as to lie in the plane of the tether straps or webbing were the webbing to remain flat, resulting in the carabiner being misaligned generally 90 degrees from such an orientation causing a helical twist in the straps or webbing.

Clipping the carabiner over the top rail of the basket stretcher places a portion of the carabiner in an exposed position outside the periphery of the stretcher. Such an outwardly exposed portion may snag on surface irregularities on the adjacent surface of a building or an escarpment as the basket stretcher is raised or lowered resulting in tipping and jerking of the basket stretcher as it elevates or descends. Further, such contact may result in rapid abrading and deterioration of the carabiner.

SUMMARY OF THE INVENTION

The stretcher of the present invention has attachment brackets which are inwardly disposed into the stretcher basket and located near the fore and aft ends of the stretcher, located equidistant from a longitudinal axis of the stretcher. The brackets permit the stretcher to be raised or lowered adjacent to a vertical or inclined surface, such as the outside of a building or an escarpment, in a manner which is relatively balanced and stable and which reduces snagging or abrading of lifting equipment against the adjacent surface of the slope.

The attachment brackets according to the present invention may be, as an example, manufactured from ½ inch diameter stainless steel rod. The brackets may form a generally inverted "L" shape, having first and second legs. The first leg may be substantially shorter than the second. The internal corner radius between the legs may be, for example, ½ inch, so as to match the corner radius on most standard carabiners. The attachment brackets may be secured by welding, or other rigid fastening, to the inside of the basket stretcher so as to extend between the peripheral top rail and, for example, the immediately adjacent second rail.

The first leg of the attachment bracket may be mounted to the inside face of the top rail so as to extend inwardly of the bracket and radially downwardly from the top rail. The second leg of the bracket may extend downwardly and may be angled toward the outside of the basket stretcher so as to intersect in a rigid mounting to the upper surface of the immediately adjacent lower rail.

The mounting member according to one aspect of the present invention is for mounting to at least an upper rail of a basket rescue stretcher, for example so as to provide for clipping of a carabiner in a generally vertical plane orthogonal to the upper rail. The mounting member is adapted for mounting, at at least one end of the mounting member, to an inner side of the rail so as to project the mounting member into the interior of the stretcher, as defined by the top rail of the stretcher. In one embodiment the mounting member is for mounting, at an oppositely disposed end, to a longitudinal member of said basket rescue stretcher extending longitudinally along the basket. The mounting member may be provided for retrofit to existing basket rescue stretchers or may be formed as part of, or mounted to as part of the manufacture of new basket rescue stretchers.

The mounting member is rigid and may be a bracket, or loop, or apertured plate which is mountable or mounted to the stretcher so that when a clip, carabiner, hook or the like is attached to the mounting member, twisting of the sling webbing is avoided and the mounting member does not have a portion projecting outwardly of the circumference of the stretcher opening or rim.

In a further aspect, the present invention may be characterized as a basket rescue stretcher apparatus or system which includes a pair of top rails extending longitudinally along upper opposite side edges of the stretcher, so as to define an opening into a stretcher cavity within the stretcher, and a pair of carabiner mounting members rigidly mounted or mountable to each top rail. The carabiner mounting members are mounted or mountable spaced longitudinally apart along the each top rail. Each carabiner mounting member extends into the stretcher cavity and defines a carabiner receiving opening which lies in a first plane which is perpendicular both to a vertical second plane containing the corresponding top rail to which the carabiner mounting member is mounted or mountable and to a horizontal third plane which contains the pair of top rails. The carabiner mounting members do not protrude outwardly from a circumference of the stretcher defined by the pair of top rails, when a carabiner is mounted through the carabiner receiving opening, it passes through the opening, that is, that portion of the carabiner which passes through the opening is aligned substantially parallel to the corresponding top rail to which the carabiner mounting member is mounted or mountable.

In one embodiment the stretcher further includes a pair of side rails extending longitudinally along opposite sides of the stretcher between the pair of top rails and a floor of the stretcher. In such an embodiment the carabiner mounting members may also be rigidly mounted to the pair of side rails. In such an embodiment the pair of side rails may be substantially parallel to the pair of top rails, and each carabiner mounting member may be an elongate member having an upper end mounted to a corresponding top rail and a lower end mounted to a corresponding side rail.

In one embodiment of the present invention the elongate member may be a bar having an inverted L-shape so as to form the carabiner receiving opening as an upper elbow of the bar protruding inwardly of the corresponding top rail and side rail. In another embodiment, the elongate member may be a plate having an aperture, for example in its upper end, so that the aperture forms the carabiner receiving opening. In such embodiments, the plate and bar have a thickness which is not larger than the size of the opening in an elbow in a carabiner to which the carabiner mounting member would be mounted.

DETAILED DESCRIPTION OF EMBODIMENTS OF THE INVENTION

Figure 1:
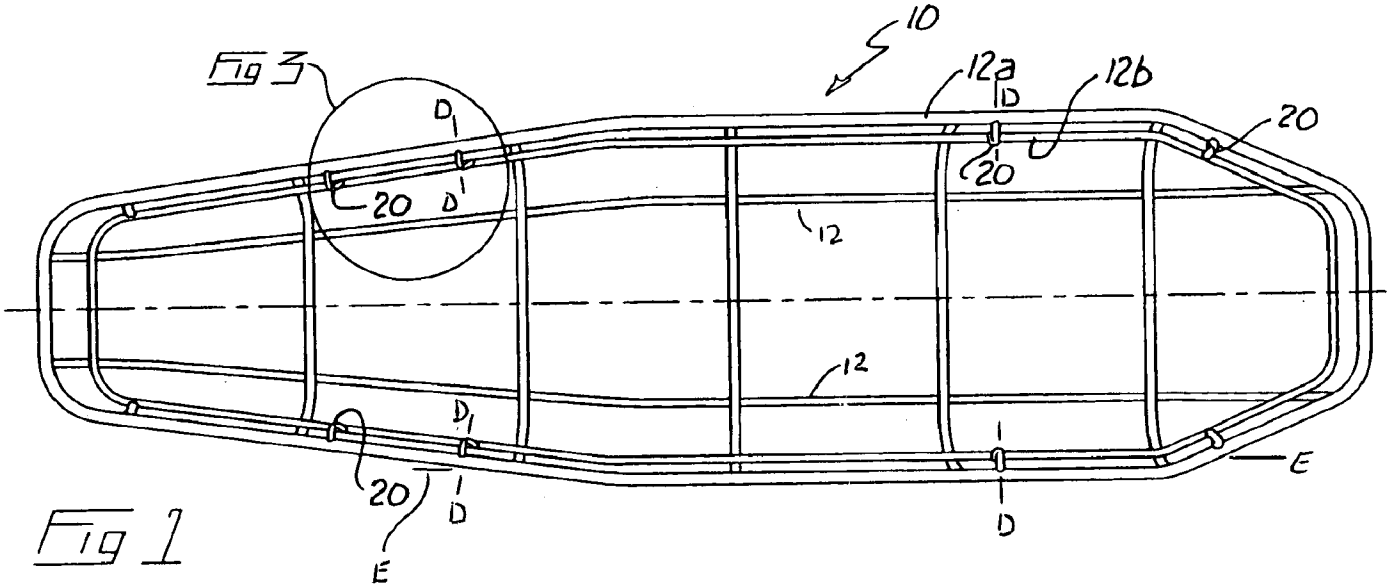
FIG. 1, is a plan view of a typical basket stretcher incorporating lifting brackets according to the present invention.
Figure 2:
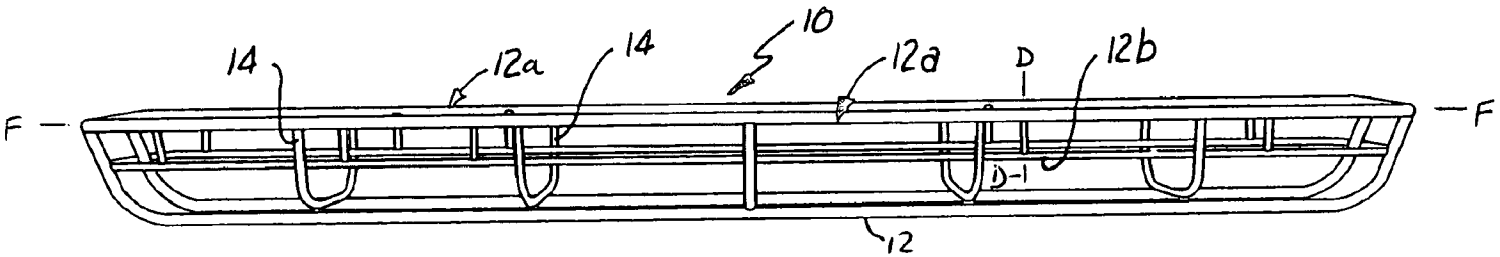
FIG. 2 is a perspective side view of the basket stretcher of FIG. 1.

With reference to the drawing figures wherein similar characters of reference denote corresponding parts in each view, as seen in FIGS. 1 and 2 basket rescue stretcher 10 includes longitudinal and lateral members such as stringers 12 and ribs 14. Stringers 12 and ribs 14 are welded together to form a rigid elongate low-sided basket. Continuous peripheral top rail 12*a* surrounds the basket opening. One or more intermediate rails 12*b* are spaced from and parallel to top rail 12*a*.

Figure 1A:
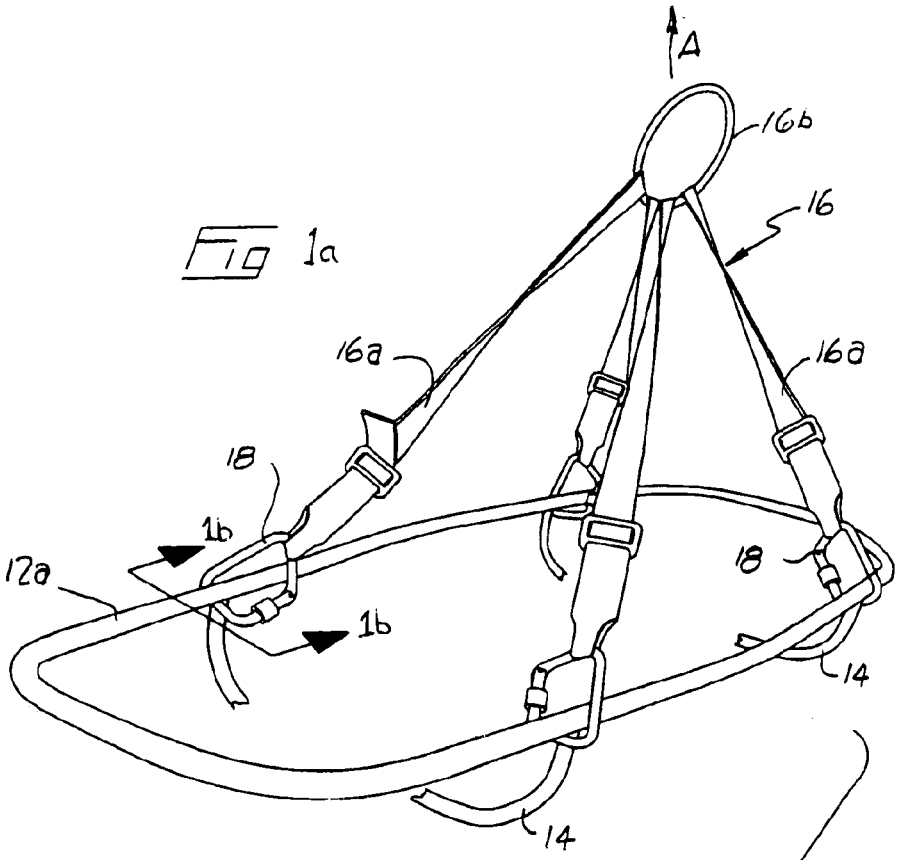
FIG. 1*a* is a perspective view of a portion of a conventional basket rescue stretcher and lifting harness.
Figure 1B:
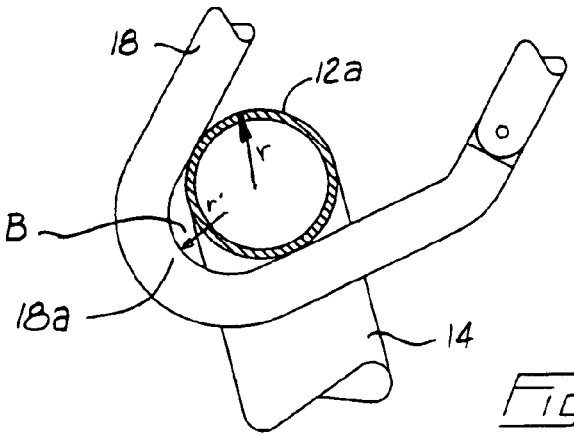
Fig 1b PRIOR ART
FIG. 1*b* is a sectional view along line 1*b*—1*b* in FIG. 1*a*.
Figure 4:
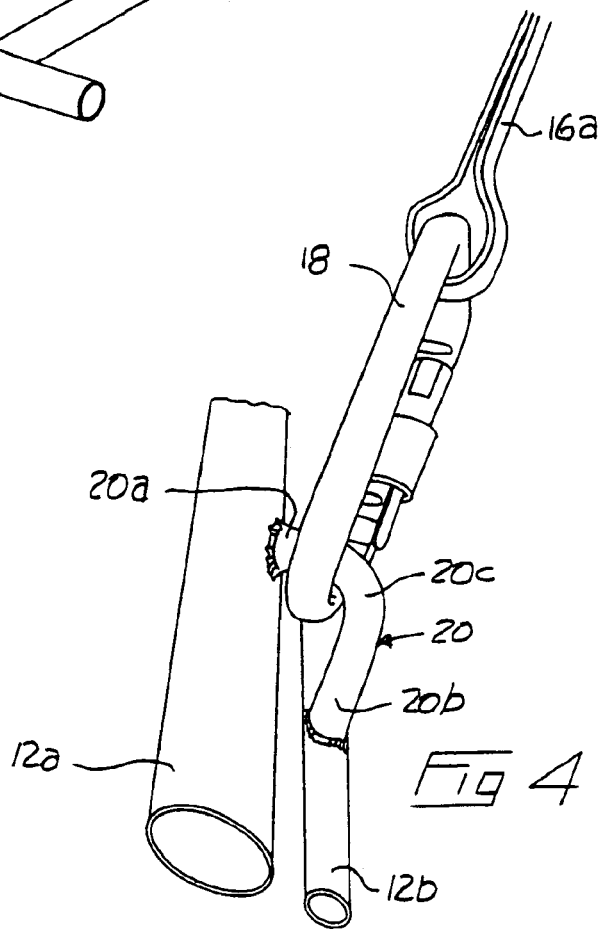
FIG. 4 is a further enlarged, partially cut away perspective view taken from FIG. 3.

In the prior art as seen in FIGS. 1*a* and 1*b*, a conventional lifting tether 16 is attached to the top rail 12*a* of basket stretcher 10 by conventional screwgate carabiners 18. When lifting tether 16 is tensioned in direction A, carabiner 18 will have a tendency to slide longitudinally along top rail 12*a* unless carabiner 18 is positioned such that any sliding movement that occurs will be immediately arrested by contact with a lateral frame component 14, such as a rib, which intersects and is secured to the top rail. Such contact between carabiner 18 and rib 14 may not be properly balanced for lifting of stretcher 10.

Top rail 12*a* may typically have a diameter in cross section which is larger than the size of the opening of corner 18*a*, that is, has a radius r which is significantly larger than the internal corner radius r' of corner 18*a* of carabiner 18. This difference in radii prevents the proper nesting of the underside of top rail 12*a* into snug mating with the corner radius of corner 18*a* of carabiner 18, thereby leaving a gap B. If a loaded stretcher is dropped a short distance and then arrested by carabiners 18 and connecting tethers 16, the sides of the tubular top rail 12*a* may be crushed slightly, or otherwise weakened by the pinching of the top rail in the radius of corner 18*a*.

Further, as seen in FIG. 1*a*, top rail 12*a* may prohibit the carabiner 18 from rotating into planar alignment with tether straps 16*a* were they to remain untwisted, resulting in the tether straps 16*a* being helically twisted for example through 90 degrees between the carabiner and the tether strap gathering ring 16*b*.

As also seen in FIGS. 1*a* and 1*b*, a substantial portion of carabiner 18 protrudes outwardly of top rail 12*a* and thus may be prone to snagging an adjacent surface of a building or an escarpment over which the stretcher is being translated. Such contact may result in tipping or jerking of the basket stretcher as, for example, it is elevated or lowered. Such contact may also result in rapid deterioration of the carabiner.

Figure 3:
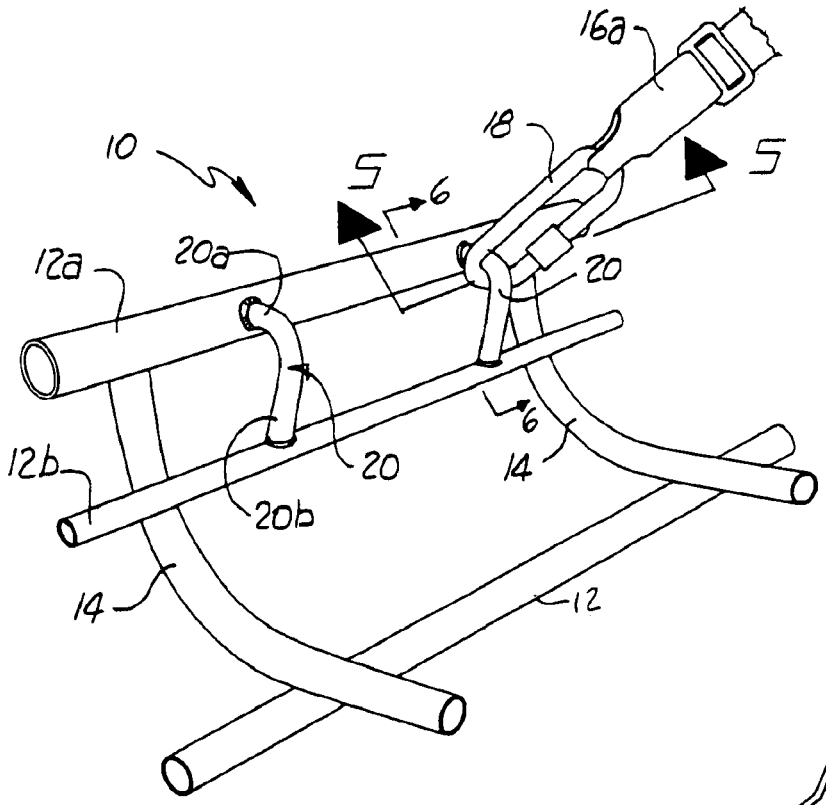
FIG. 3 is an enlarged perspective view of a portion of FIG. 1, illustrating a lifting carabiner and strap clipped to a lifting bracket.
Figure 3A:
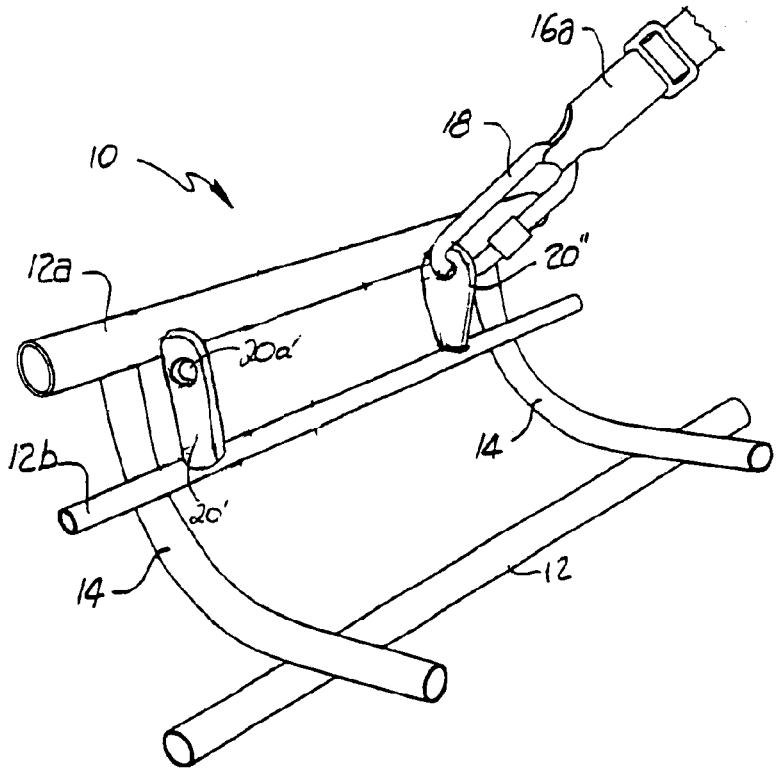
FIG. 3*a* is an alternative embodiment of the lifting bracket of FIG. 3.
Figure 5:
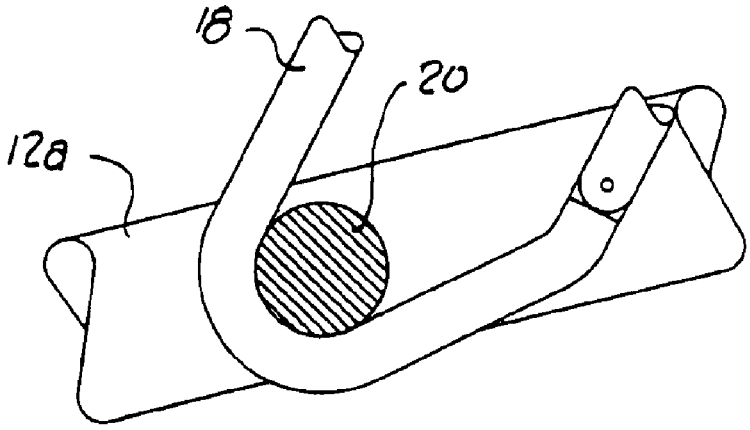
FIG. 5 is a sectional view along line 5—5 in FIG. 3.

As better seen in FIGS. 3–6, carabiner mounting or attachment brackets 20 are rigidly mounted to top rail 12*a* and to an adjacent member such as intermediate rail 12*b*. Brackets 20 extend inwardly of the basket of stretcher 10, that is, towards the centerline of the stretcher. They may be manufactured for example from ½ inch diameter stainless steel rod. Brackets 20 have, in one embodiment which is not intended to be limiting, first and second legs 20*a* and 20*b* respectively, extending from an intermediate arcuate corner or shoulder 20*c*. Advantageously corner or shoulder 20*c* has a corner radius that matches, that is corresponds to, or exceeds the corner radii of corners 18*a* of standard carabiners, and has a smaller cross sectional diameter than the size of the corner opening of a standard carabiner so as to avoid the pinching problem. First leg 20*a* may be substantially shorter than the second leg 20*b*, so that bracket 20 takes the form of an inverted "L". In the alternative embodiments shown in FIG. 3*a*, which again is not intended to be limiting, attachment brackets 20' and 20" are formed as a rigid elongate plate mounted at their ends to rail 12*a* and 12*b*. Each plate has an aperture (20*a*') for receiving a carabiner hooked therethrough and is sufficiently thin so as to snugly nest into corner 18*a* of the carabiner without pinching.

Brackets 20, 20' and 20" are mounted on the inside of stretcher 10 with, for example, first leg 20*a* or the plate secured, as by welding, to the inwardly exposed face of top rail 12*a*. Brackets 20, 20' and 20" extend inwardly of the basket from top rail 12*a* and downwardly until their lower end, for example the lower end of second leg 20*b*, contacts the upper surface of the immediately adjacent lower rail 12*b*, where it is mounted by welding or the like.

Brackets 20, 20' and 20" may be positioned singularly or in pairs on the inner sides of stretcher 10, adjacent each end. The positioning may advantageously be equidistant from the center of mass of stretcher 10, so as to provide stable and balanced attachment points for lifting or lowering the stretcher and an associated patient.

The attachment brackets may be shaped, for example, other than in the form of an inverted "L". For example a hook or loop or eye or linear or arcuate strut or member extending between the top rail and an adjacent intermediate rail or a stringer, on the inside of the basket of the stretcher, will serve as a clipping mount for a carabiner 18 if the carabiner is, when clipped on and under tension, lying in a plane which is generally parallel to the top rail and the carabiner is solely under tension with no bending moment acting to bend the carabiner out of its planar shape, and preferably free to rotate about its radii 18*a* without a pinching applied to the top rail.

Figure 6:
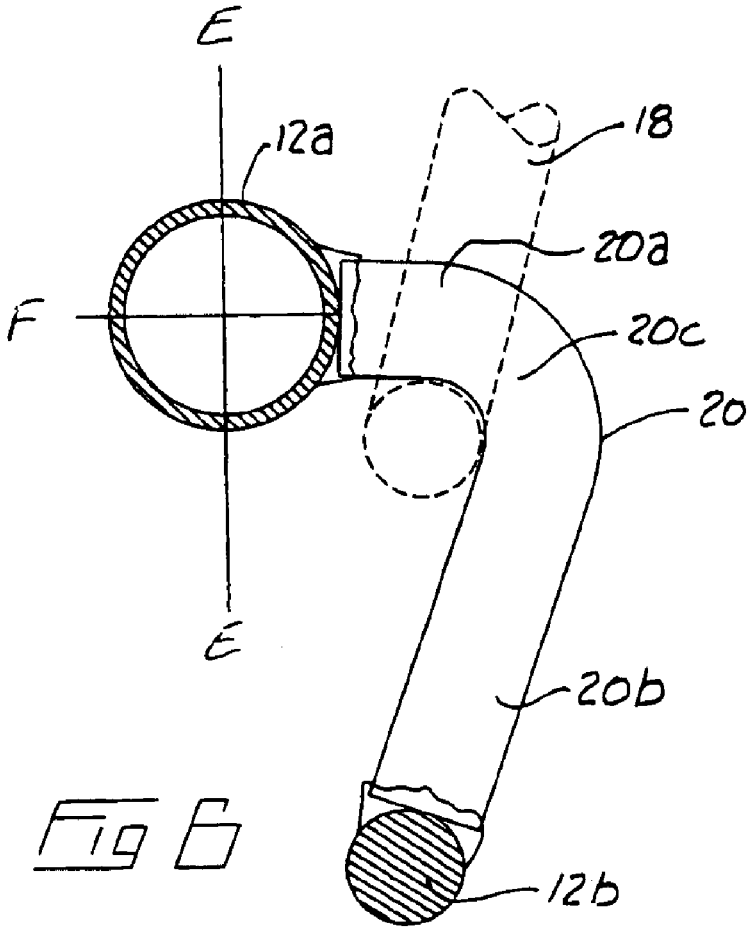
FIG. 6 is a sectional view along line 6—6 in FIG. 3.

Thus the attachment brackets may be characterized as not protruding outwardly of the circumference of the stretcher defined by the top rails, but, rather, as protruding only inwardly from the top rails in first places D, as seen in FIG. 1, which are perpendicular to vertical second planes E containing the top rails such as seen in FIG. 6. The carabiner receiving openings, such as defined by corner 20*c* or by aperture 20*a*', may be characterized as lying in the first planes D. First planes D may also be characterized as being orthogonal to a third place F which contains the pair of top rails on opposite sides of the stretcher.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A basket rescue stretcher apparatus which includes:

a pair of top rails extending longitudinally along upper opposite side edges of the stretcher so as to define an opening into a stretcher cavity within the stretcher, at least two pairs of carabiner mounting members rigidly mounted to the stretcher, each said pair of carabiner mounting members mounted spaced longitudinally apart along the stretcher rail, each carabiner mounting member of said pair of carabiner mounting members extending into said stretcher cavity and defining a carabiner receiving opening which lies in a first plane which is substantially perpendicular both to a vertical second plane containing a corresponding said top rail and to a horizontal third plane which contains said pair of top rails, wherein at least said carabiner receiving opening protrudes inwardly from a circumference of the stretcher defined by said pair of top rails, and whereby a carabiner when mounted through said carabiner receiving opening passes through said opening aligned substantially parallel to the corresponding said top rail.

2. The apparatus of claim 1 wherein the stretcher further includes a pair of side rails extending longitudinally along opposite sides of the stretcher between said pair of top rails and a floor of the stretcher, and wherein said carabiner mounting members are rigidly mounted to said pair of side rails.

3. The apparatus of claim 2 wherein said pair of side rails are substantially parallel to said pair of top rails and wherein each said carabiner mounting member is an elongate member having an upper end mounted to a corresponding said top rail and a lower end mounted to a corresponding said side rail.

4. The apparatus of claim 3 wherein said elongate member is a bar having an inverted L-shape so as to form said carabiner receiving opening as an upper elbow of said bar protruding inwardly of the corresponding said top rail and side rail.

5. The apparatus of claim 4 wherein said bar has a thickness which is not larger than the size of the opening in an elbow in a carabiner to which said carabiner mounting member would be mounted.

6. The apparatus of claim 3 wherein said elongate member is a plate having an aperture therein so that said aperture forms said carabiner receiving opening.

7. The apparatus of claim 6 wherein said plate has a thickness which is not larger than the size of the opening in an elbow in a carabiner to which said carabiner mounting member would be mounted.

8. The apparatus of claim 6 wherein said aperture is at said upper end of said plate.

9. A basket rescue stretcher system which includes:

a pair of top rails extending longitudinally along upper opposite side edges of the stretcher so as to define an opening into a stretcher cavity within the stretcher, a pair of carabiner mounting members rigidly mountable to the stretcher, each said pair of carabiner mounting members mountable spaced longitudinally apart along the stretcher, each carabiner mounting member of said pair of carabiner mounting members extending into said stretcher cavity and, when mounted to the stretcher extending into said stretcher cavity and defining a carabiner receiving opening which lies in a first plane which is substantially perpendicular both to a vertical second plane containing the corresponding said top rail and to a horizontal third plane which contains said pair of top rails, wherein at least said carabiner receiving opening of said carabiner mounting members protrudes inwardly from a circumference of the stretcher defined by said pair of top rails, and whereby a carabiner when mounted through said carabiner receiving opening passes through said opening aligned substantially parallel to the corresponding said top rail.

10. The apparatus of claim 9 wherein the stretcher further includes a pair of side rails extending longitudinally along opposite sides of the stretcher between said pair of top rails and a floor of the stretcher, and wherein said carabiner mounting members are rigidly mounted to said pair of side rails.

11. The apparatus of claim 10 wherein said pair of side rails are substantially parallel to said pair of top rails and wherein each said carabiner mounting member is an elongate member having an upper end mountable to a corresponding said top rail and a lower end mountable to a corresponding said side rail.

12. The apparatus of claim 11 wherein said elongate member is a bar having an inverted L-shape so as to form said carabiner receiving opening as an upper elbow of said bar protruding inwardly of the corresponding said top rail and side rail when mounted thereto.

13. The apparatus of claim 12 wherein said bar has a thickness which is not larger than the size of the opening in an elbow in a carabiner to which said carabiner mounting member would be mounted.

14. The apparatus of claim 11 wherein said elongate member is a plate having an aperture therein so that said aperture forms said carabiner receiving opening.

15. The apparatus of claim 14 wherein said plate has a thickness which is not larger than the size of the opening in an elbow in a carabiner to which said carabiner mounting member would be mounted.

16. The apparatus of claim 14 wherein said aperture is at said upper end of said plate.

* * * * *